United States Patent [19]

Wheeler

[11] 4,266,705

[45] May 12, 1981

[54] CARRIER FOR GARMENT HANGERS

[76] Inventor: Raymond R. Wheeler, 39, Nixon St., Hamilton, New Zealand

[21] Appl. No.: 148,883

[22] Filed: May 12, 1980

Related U.S. Application Data

[63] Continuation of Ser. No. 912,685, Jun. 6, 1978, abandoned.

[51] Int. Cl.[3] ..... B65D 71/00

[52] U.S. Cl. ..... 294/163; 211/124; 294/143; 294/169; 294/166

[58] Field of Search ..... 224/45 T, 45 P, 45 Q; 211/124; 24/241 SP; 248/308, 360

[56] References Cited

U.S. PATENT DOCUMENTS

| | | | |
|---|---|---|---|
| 1,650,715 | 11/1927 | Hildebrandt | 24/241 SP |
| 2,769,587 | 11/1956 | Threeton | 224/45 T |
| 3,065,513 | 11/1962 | Warner et al. | 24/241 SP |
| 3,306,465 | 2/1967 | Brennan | 211/124 |
| 3,317,055 | 5/1967 | Roscicki | 224/45 T |
| 3,458,051 | 7/1969 | Zeman et al. | 211/124 |
| 3,610,423 | 10/1971 | Parillo | 211/124 X |
| 3,804,310 | 4/1974 | Wheeler | 224/45 T |

*Primary Examiner*—Steven M. Pollard
*Attorney, Agent, or Firm*—William A. Drucker

[57] ABSTRACT

A carrier, for holding the hook portion of one or more conventional garment hangers, includes a saddle with a bearing surface to receive the hanger hooks, one or more locking elements carried by the saddle member and movable to one position to overlie the bearing surface to retain hanger hooks therein and to another position in which hooks are freely engageable and removable, and a handle coupled to the saddle.

11 Claims, 12 Drawing Figures

CARRIER FOR GARMENT HANGERS

This is a continuation of Ser. No. 912,685 filed June 6, 1978, now abandoned.

This invention relates to the carrying and supporting of garment hangers.

BACKGROUND OF THE INVENTION

The holding of several such hanger hooks by use of the fingers is awkward and uncomfortable, particularly if a considerable weight of clothing is being carried. Further, removal or addition of hooks may cause the grasp to be lost on the hooks.

OBJECTS OF THE INVENTION

A first object of the invention is to provide improvements in the general kind of carrier, for garment hangers, which is set forth in the specification of my U.S. Pat. No. 3,804,310 the content of which is included herein as a whole by reference.

A second object is to provide an improvement to such a carrier wherein locking and unlocking of the carrier, respectively for preventing removal or addition of a hook, and for permitting removal or addition of a hook, is considerably simplified.

A third object of the invention is to provide an improved form of carrier, for garment hangers, which eliminates supporting of the individual hanger hooks on the fingers, so that one or more such hangers may be conveniently and comfortably supported by hand. It is particularly advantageous for those travellers using the "carry on" garment bags. These bags are usually zippered to enclose the garments, leaving only the several hooks exposed at the top of the bag. Other features and advantages of the invention will be apparent from the following description.

SUMMARY OF THE INVENTION

According to the present invention, a carrier for garment hangers comprises a saddle member which includes a recessed support surface adapted to receive a plurality of garment hanger hooks in side by side relationship, locking means carried by said saddle member and movable thereon into a first position in which to overlie the bearing surface to retain a hanger hook thereon, and a displaced position permitting free engagement and disengagement of a hanger hook on and from the bearing surface, a handle, and means coupling the handle to the saddle member.

In a first preferred embodiment, the saddle member includes a locking portion which is recessed, the locking means being pivotable on the saddle member for movement into a centralised position in which the locking means is aligned with the bearing surface and is engaged into the recessed locking portion, and into a displaced position in which the locking means is non-aligned with the bearing surface and is disengaged from the recessed locking portion. Conveniently, for storing and transportation the means coupling the handle to the saddle member permit rotation of the handle about two axes, at 90° to each other, with respect to the saddle member.

The saddle member may include a central sleeve, the coupling means being a suspension shaft engaged rotatably in said sleeve but prevented from axial movement therein, one end of said shaft projecting from the sleeve, and the handle being C-shaped and having one of its ends engaged through the projecting portion of the shaft.

The saddle member advantageously has two portions of bearing surface extending at 180° opposed positions from the sleeve, two locking members being pivoted on the sleeve at 180° opposed positions aligned with the portions of bearing surface.

An eyelet may be secured to the saddle member for hanging it on a hook, and in a preferred form, the projecting portion of the shaft is a head on the shaft, and an eyelet is positioned about the shaft and is held between said head and the sleeve of the saddle member.

In a second preferred embodiment, the locking means is resiliently deformable for movement into a locking position in which it is aligned with the bearing surface, and into a displaced position in which is displaced away from the bearing surface. The locking means is preferably shaped to permit clipping over a lip of the saddle for retention of the locking means firmly but removably in the locking position. The saddle member may advantageously be recessed to receive the locking means when the latter is in locking position, whereby the carrier as a whole may present a smooth external surface.

DESCRIPTION OF THE PREFERRED EMBODIMENTS

Figure 1:
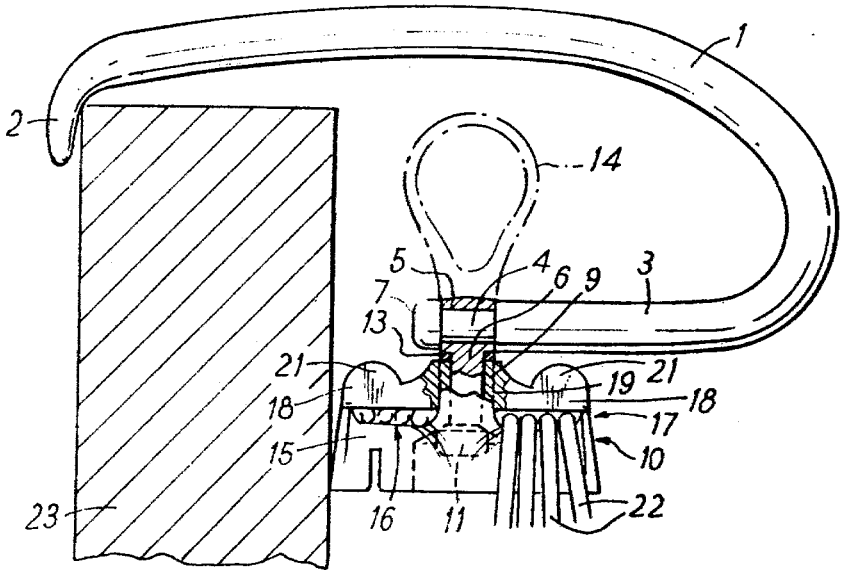
FIG. 1 is an elevation of a first embodiment of carrier, with a plurality of hanger hooks thereon, seen from a first direction.

Referring to FIGS. 1 to 5, the carrier comprises a handle 1 of C-shape with an incurved tip 2 at one end. The other end of the carrier has a straight portion 3 with a zone 4 of reduced diameter engaged through an aperture in a head 5 of a suspension shaft 6. The portion 3 is retained in the head 5 of the suspension shaft by a cap 7 forced onto ribbing 8. The shaft has a plain portion on which is freely rotatable a tubular sleeve 9 of a saddle member 10, and the saddle member is retained on the suspension shaft by a cap 11 forced onto ribbing 12. Between the underside of the head 5 of the shaft, and the upper end of the sleeve 9 there is disposed a ring 13 forming part of a suspension eyelet 14 which is also freely rotatable on the shaft.

The saddle member includes a saddle portion 15 having two upper ridge-like bearing surfaces 16 disposed 180° apart one at each side of the axis of the shaft 6. At the radially outer end of each bearing surface there is a locking portion 17. The bearing surfaces 16 are inclined in the direction to cause hanger hooks thereon to slide towards the axis of the shaft 6. On the sleeve 9, at two positions 180° opposed, there are provided respective locking gate members 18, 18 each of which is effectively hinged at 19, by the resilient flexibility of the material of which the saddle member as a whole is composed, so as to be movable from a centralised position, as seen in full lines in FIG. 5, to either side into a displaced position, as shown in broken line in FIG. 5.

When the locking gate 18 is in its centralised position, its underside is seated in a recess 20 provided in the peak of the respective locking portion 17, and this serves to retain the locking gate 18 firmly but removably in its centralised position. Finger pressure can be applied to the ears 21 of the locking gates 18, 18 to move them into the centralised position and into the displaced positions.

Figure 2:
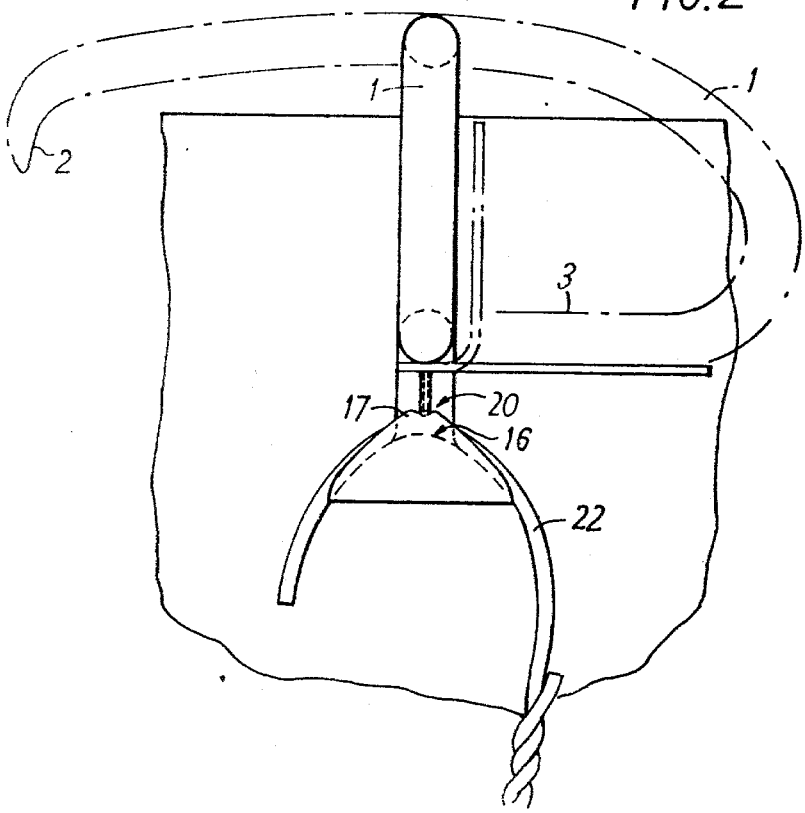
FIG. 2 is an elevation of the carrier, with a single hanger hook thereon, seen from a second direction at a right angle to that of FIG. 1.

As seen in FIGS. 1 and 2, the curved hook 22 of a conventional wire clothes hanger can be engaged over either one of the bearing surfaces 16 of the saddle member so as to be supported by the carrier. This engagement is most easily carried out by moving the respective gate 18 to its displaced position, placing the hook 22 onto the bearing surface, and thereafter returning the gate 18 to its centralised position. When the gate has been placed in the centralised position it overlies the or each hanger hook on the bearing surface, and serves to retain such hook or hooks and prevent it or them from coming off the carrier.

The carrier as a whole can readily be engaged, by its handle 1 and tip 2, on any convenient structure or piece of furniture. As illustrated in FIG. 1, the tip 2 of the handle is engaged over the top of a member 23 which could be, for example, the top portion of a door, or a rail of a chair or a bedstead, and the carrier is held stably in position. The hooks 22 of the hangers can seat on the saddle member 10 at positions which are slightly swung outwardly about the axis of the hook wire, thereby to accommodate the thickness of the garments carried on the respective hangers.

Referring to FIGS. 6 through 9, there is shown a modified construction, wherein the gate members **18*a* are provided on an external sleeve 18*b* which is keyed at 18*c* on the outside of the sleeve 9. Further, the shoulder is shaped so that the recess 20*a* (see FIG. 8) has a higher and substantially vertical side wall, seen at the left hand side in the drawing, which acts as a stop preventing overriding by the gate member 18*a* and ensuring that the gate member can be pivoted in only one direction away from the centralised position in which it engages in the recess 20**.

Figure 3:
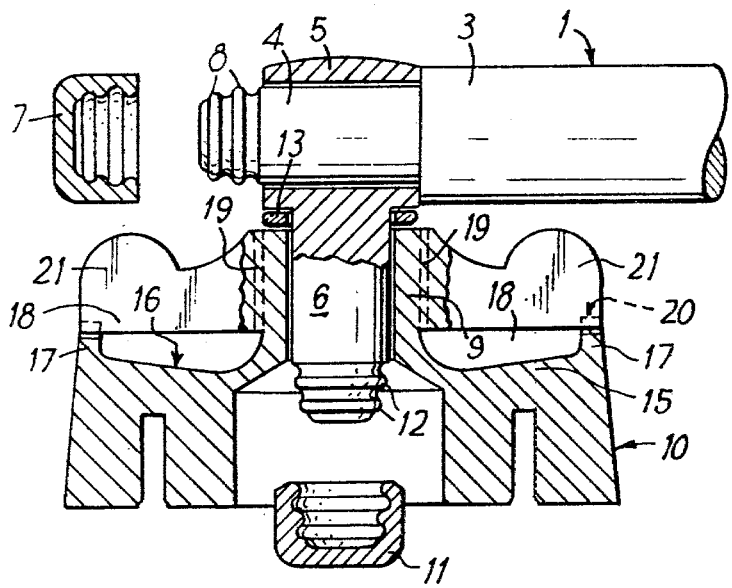
FIG. 3 is a detailed view of a portion of the carrier, with parts seen in separated position.
Figure 4:
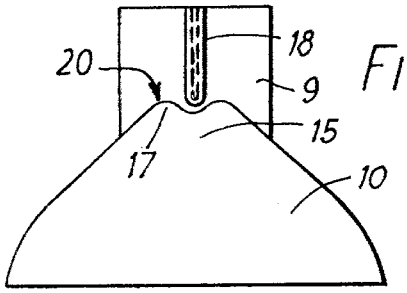
FIG. 4 is an elevation of a saddle to show gate locking recesses.
Figure 5:
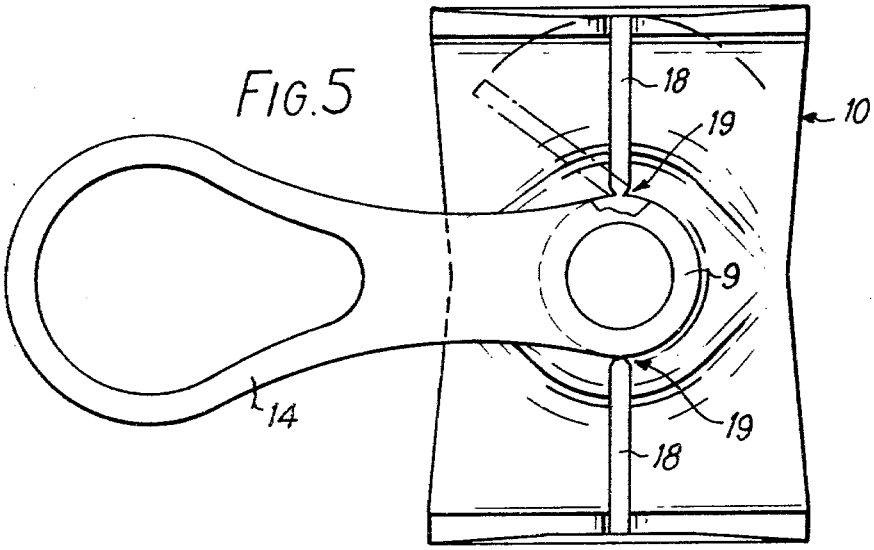
FIG. 5 is a plan view of the saddle to show pivoted locking gates.
Figure 6:
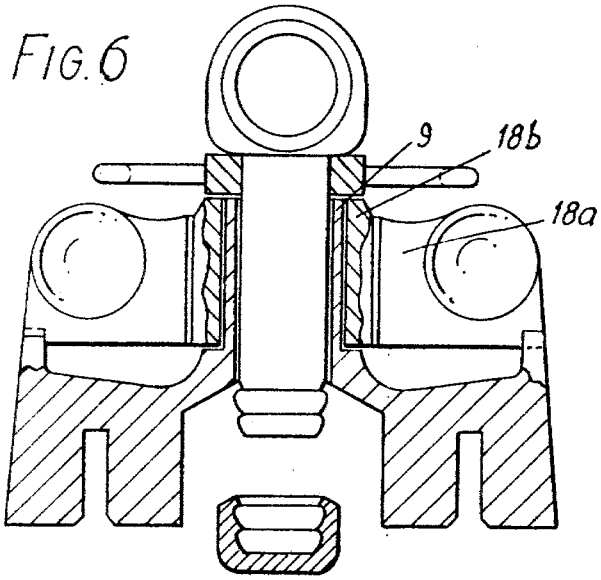
FIG. 6 is a view, corresponding to that of FIG. 3, of a modified construction wherein gate members are integrally hinged on a sleeve which is keyed on the sleeve of the saddle.
Figure 8:
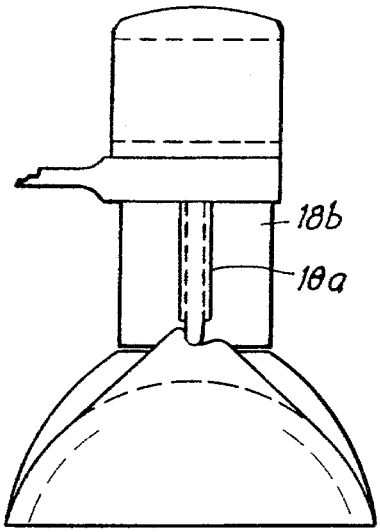
FIG. 8 is an elevation, corresponding to that of FIG. 4, of the modified construction of FIG. 6.
Figure 7:
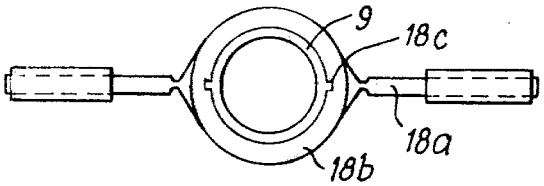
FIG. 7 is a plan view of a portion of the modified construction of FIG. 6.
Figure 9:
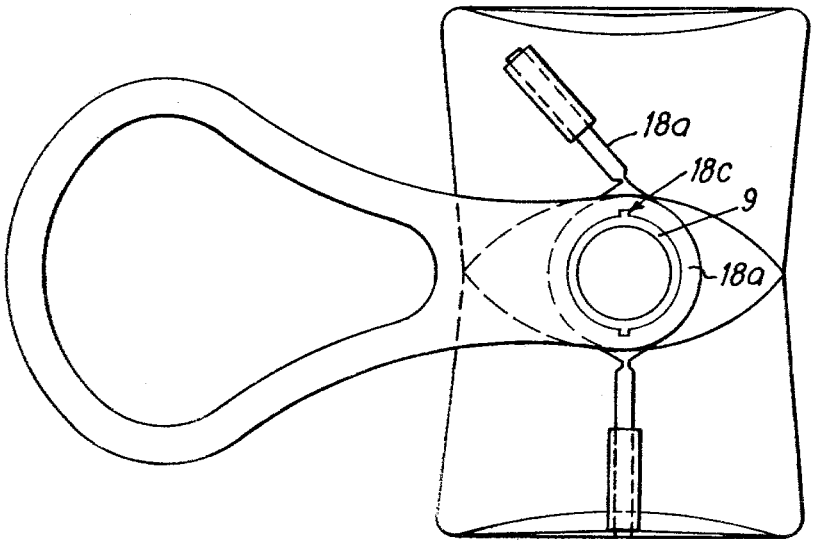
FIG. 9 is a plan view, corresponding to that of FIG. 5, of the modified construction of FIG. 6.
Figure 10:
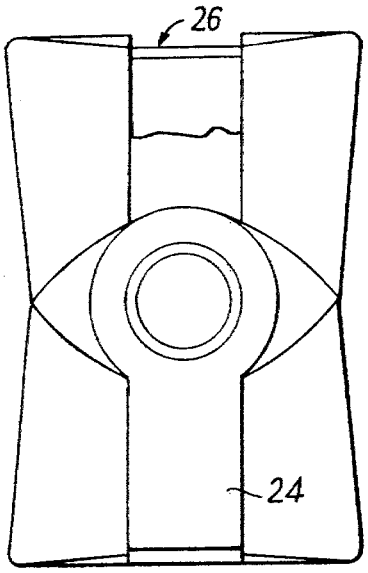
FIG. 10 is a plan view of a second embodiment.
Figure 11:
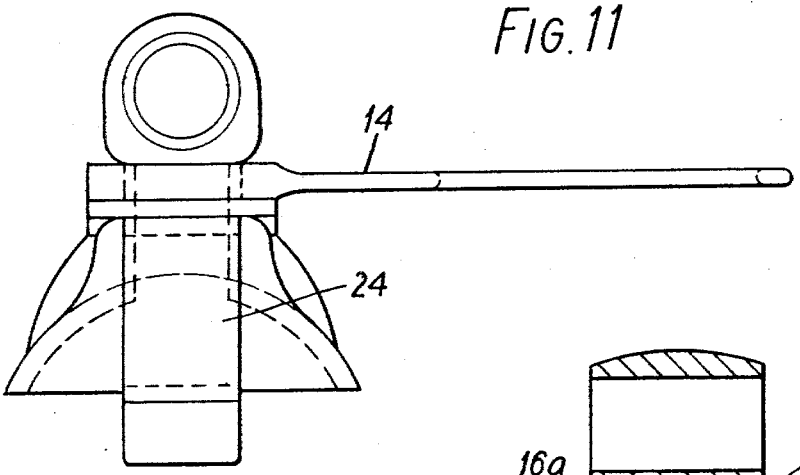
FIG. 11 is a side elevation of the second embodiment of FIG. 10.
Figure 12:
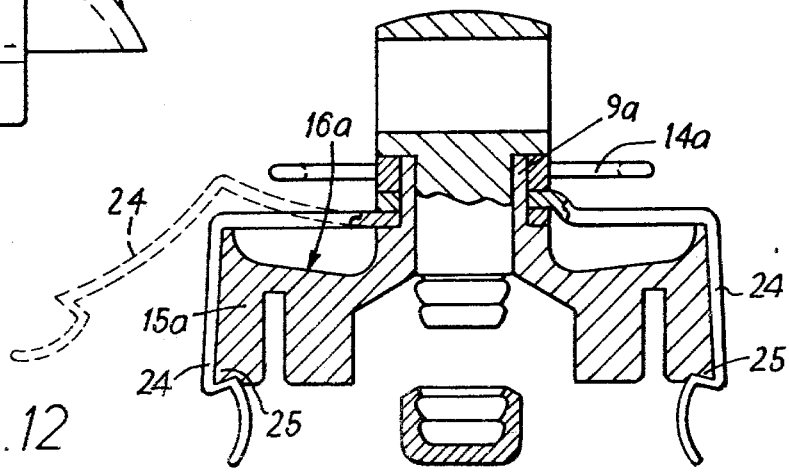
FIG. 12 is a front elevation of the second embodiment of FIG. 10.

Referring now to FIGS. 10 and 11 there is shown a second embodiment wherein the eyelet **14*a* is shown as journalled on the sleeve 9*a*, rather than on the suspension shaft 6 as seen in FIG. 3. Also, in this construction, the pivotable gate members 18 are replaced by locking clips 24 which are each engaged on the outside of the sleeve 9*a* and which are resiliently bendable to permit them to be snapped into the locking position shown in FIG. 12 in which they engage under a lip 25 of the saddle 15*a*, and also to be forced outwardly into a releasing position, shown in broken line, in which they are moved away from directly overlying the bearing surface 16*a* of the saddle. The opposed end surfaces of the saddle 15*a* are recessed, as at 26, to receive the clips 24 when the latter are in locking position, one of the clips being shown broken away in FIG. 10 to show the recessing 26. The clips 24** may be of, for example, plastics material or spring steel. The recessing of the clips into the end surfaces of the saddle provides a smooth surface when the saddle end bears against a door or piece of furniture.

The device permits comfortable supporting, for holding, hanging or carrying by hand, of a plurality of loaded wire hangers. This device enables one to perform the task of holding hangers conveniently and comfortably because it eliminates the cutting into the fingers by the individual hanger hooks. It makes it virtually impossible to drop a hanger, even when changing hands or removing a particular hanger from the others on the carrier. All of the hangers are held in complete comfort, because of the design of the handle 1.

The handle 1 can swivel through a full 360° in relation to the hangers, about the axis of the shaft 6, and it can also be folded down, about the axis of the zone 4, to save space when being packed or stored. When attached to a loaded garment bag, this carrier provides functional comfort at one's side, over the shoulder, on a closet hanger rod, on a hook, peg or over the top of a door.

I claim:

1. A carrier for garment hangers comprising:

(i) a saddle member which includes (a) a recessed bearing surface adapted to receive a plurality of garment hanger hooks in side by side relationship (b) recessed locking portions at end points on said saddle member (ii) locking means carried by said saddle member and movable about an axis substantially perpendicular to said saddle member into a first position in which the locking means is aligned with the bearing surface and is engaged into the recessed locking portions, and into a second displaced position in which the locking means is disengaged from the recessed locking portions permitting free engagement and disengagement of a hanger hook on and from the bearing surface, (iii) a handle, and (iv) means coupling the handle to the saddle member.

2. A carrier, as claimed in claim 1, wherein the means coupling the handle to the saddle member permit rotation of the handle about two axes, at 90° to each other, with respect to the saddle member.

3. A carrier, as claimed in claim 1, wherein the saddle member includes a central sleeve, and wherein the coupling means is a suspension shaft engaged rotatably in said sleeve but prevented from axial movement therein, one end of said shaft projecting from the sleeve, and wherein the handle is C-shaped and has one of its ends engaged through the projecting portion of the shaft.

4. A carrier, as claimed in claim 3, wherein the saddle member has two portions of bearing surface extending at 180° opposed positions from the sleeve, and wherein two locking gates are pivoted on the sleeve at 180° opposed positions aligned with the portions of bearing surface.

5. A carrier, as claimed in claim 3, wherein the projecting portion of the shaft is a head on the shaft, and wherein an eyelet is positioned about the shaft and is held between said head and the sleeve of the saddle member.

6. A carrier, as claimed in claim 1, including an eyelet secured to the saddle member.

7. A carrier, as claimed in claim 1, wherein the locking means is resiliently deformable for movement into a locking position in which it is aligned with the bearing surface, and into a displaced position in which it is displaced away from the bearing surface.

8. A carrier, as claimed in claim 7, wherein the locking means is shaped to permit clipping over a lip of the saddle for retention of the locking means firmly but removably in the locking position.

9. A carrier, as claimed in claim 7, wherein the saddle member is recessed to receive the locking means when in locking position.

10. A carrier for garment hangers comprising:

(i) a saddle member which includes (a) a recessed bearing surface adapted to receive a plurality of garment hanger hooks in side by side relationship (b) at least one recessed locking portion at an end of said bearing surface (ii) at least one locking means carried by said saddle member and movable about an axis substantially perpendicular to said bearing surface into a first position in which the locking means is aligned with the bearing surface and is engaged into the at least one recessed locking portion, and into a second displaced position in which the locking means is disengaged from the recessed locking portion permitting free engagement and disengagement of a hanger hook on and from the bearing surface, (iii) a handle, and (iv) means coupling the handle to the saddle member.

11. A carrier for garment hangers comprising:

(i) a saddle member which includes (a) a recessed bearing surface adapted to receive a plurality of garment hanger hooks in side by side relationship (b) at least one recessed locking portion at an end of said saddle member (ii) at least one locking means carried by said saddle member and movable with resilient deformation into a first position in which it is aligned with the bearing surface and is engaged with the at least one recessed locking portion, and into a second displaced position in which it is disengaged from the recessed locking portion thereby permitting free engagement and disengagement of a hanger hook on and from the bearing surface, (iii) a handle, and (iv) means coupling the handle to the saddle member.

* * * * *